US006210589B1

(12) United States Patent
Lee et al.

(10) Patent No.: US 6,210,589 B1
(45) Date of Patent: Apr. 3, 2001

(54) PROCESS FOR REMOVING FLUORIDE FROM WASTEWATER

(75) Inventors: Mao-Sung Lee, Hsinchu; Chi-Chung Liao, Hsinchu Hsien; Hsin Shao; Wang-Kuan Chang, both of Hsinchu, all of (TW)

(73) Assignee: Industrial Technology Resarch Institute, Hsinchu (TW)

( * ) Notice: Subject to any disclaimer, the term of this patent is extended or adjusted under 35 U.S.C. 154(b) by 0 days.

(21) Appl. No.: 09/471,338

(22) Filed: Dec. 23, 1999

(30) Foreign Application Priority Data

Jun. 7, 1999 (TW) ..... 088109410

(51) Int. Cl.[7] ..... C02F 1/52

(52) U.S. Cl. ..... 210/711; 210/724; 210/726; 210/915

(58) Field of Search ..... 210/710, 711, 210/712, 713, 723, 724, 726, 915

(56) References Cited

U.S. PATENT DOCUMENTS 4,028,237 * 6/1977 Nishimura et al. ..... 210/915
5,043,072 * 8/1991 Hitotsuyanagi et al. ..... 210/638
5,106,509 * 4/1992 Jansen ..... 210/715
5,580,458 * 12/1996 Yamasaki ..... 210/609
5,750,033 * 5/1998 Ikeda et al. ..... 210/711

FOREIGN PATENT DOCUMENTS

51032060 * 9/1974 (JP) .
57027191 * 7/1980 (JP) .
59-000373 * 1/1984 (JP) .
60-097091 * 5/1985 (JP) .
04-171086 * 6/1992 (JP) .
05-015882 * 1/1993 (JP) .

* cited by examiner

*Primary Examiner*—David A. Simmons
*Assistant Examiner*—Frank M. Lawrence
(74) *Attorney, Agent, or Firm*—Sughrue, Mion, Zinn, Macpeak & Seas, PLLC

(57) ABSTRACT

A process for removing fluoride from wastewater is presented. Calcium (or magnesium), sodium and aluminum reagents are added into a fluidized bed crystallizer to remove most of the fluoride in wastewater. The remaining fluoride is removed by aluminum hydroxide. Alternatively, two fluidized bed crystallizers are used in series to treat the fluoride-containing wastewater: in the first fluidized bed crystallizer, calcium (or magnesium), sodium and aluminum reagents are used to treat the wastewater which contains high concentrations of fluoride, so that the fluoride concentrations thereof are largely reduced. Then, in the second fluidized bed crystallizer, a calcium reagent is added to further remove fluoride therein.

14 Claims, 4 Drawing Sheets

PROCESS FOR REMOVING FLUORIDE FROM WASTEWATER

BACKGROUND OF THE INVENTION

1. Field of the Invention

The present invention relates in general to an economical and efficient process for removing fluoride from wastewater.

2. Description of the Related Art

In various industries, such as the production of semiconductors, chlorofluorocarbon (CFC) and glass, a large amount of fluoride-containing wastewater with a high concentration of fluoride is produced. Therefore, many researchers have attempted to remove fluoride from the fluoride-containing wastewater.

Jansen in U.S. Pat. No. 5,106,509 has disclosed a crystallization process for removing fluoride from wastewater in a fluidized bed reactor. The process involves adding $CaCl_2$ into wastewater to react calcium ions and fluoride in the wastewater to form calcium fluoride crystals. Compared with the coagulation/precipitation process that is used in factories to date, the advantages of Jansen's process are that the waste sludge is decreased and can be recycled. Since calcium fluoride has a very low solubility, such a crystallization process can effectively remove a great amount of fluoride. However, another result of the low solubility is that calcium fluoride will easily supersaturate in some locations, thus generating fine particles that may clog the pipes. For this reason, in practical use, wastewater discharged from the factory with a high concentration of fluoride should be diluted to a concentration lower than 500 $mgF^-/l$. In order to accommodate such a great amount of diluted wastewater, the cost of manufacturing the apparatus for processing wastewater and the space occupied by the apparatus increase.

Japanese Patent No. 6-88026 has disclosed another process for removing fluoride from wastewater, in which sodium, calcium, aluminum and fluoride ions are maintained at appropriate ratios to form pachnolite. Then, the pachnolite is filtered out and recycled. Japanese Patent No. 5-15882 has disclosed another process for removing fluoride from wastewater, in which sodium, calcium and aluminum reagents are mixed and then added into the wastewater to form pachnolite. The two Japanese Patents are not so successful because the effectiveness of the removal fluoride is not very good (by the former, the fluoride concentration is reduced from 1,000 $mgF^-/l$ to 100 $mgF^-/l$, and by the latter, the fluoride concentration is reduced from 2,000 $mgF^-/l$ to 116 $mgF^-/l$) and the required reaction time is long (3.5 hours). In addition, the obtained product (pachnolite) is in form of particles. Separating the particles from the treated wastewater and transporting the particles are not easy.

SUMMARY OF THE INVENTION

An object of the present invention is to provide a process for removing fluoride from wastewater without the above-mentioned problems.

Calcium (or magnesium), sodium and aluminum reagents are added into a fluidized bed crystallizer to remove most of the fluoride in the wastewater. The remaining fluoride is removed by aluminum hydroxide. Alternatively, two fluidized bed crystallizers are used in series to treat the fluoride-containing wastewater: in the first fluidized bed crystallizer, calcium (or magnesium), sodium and aluminum reagents are used to treat the wastewater which contains high concentrations of fluoride, so that the fluoride concentrations thereof are largely reduced. Then, in the second fluidized bed crystallizer, a calcium reagent is added to further remove fluoride therein.

BRIEF DESCRIPTION OF THE DRAWINGS

The present invention can be more fully understood by reading the subsequent detailed description and examples with references made go the accompanying drawings, wherein.

DETAILED DESCRIPTION OF THE PREFERRED EMBODIMENT

EXAMPLE ONE

Figure 1:
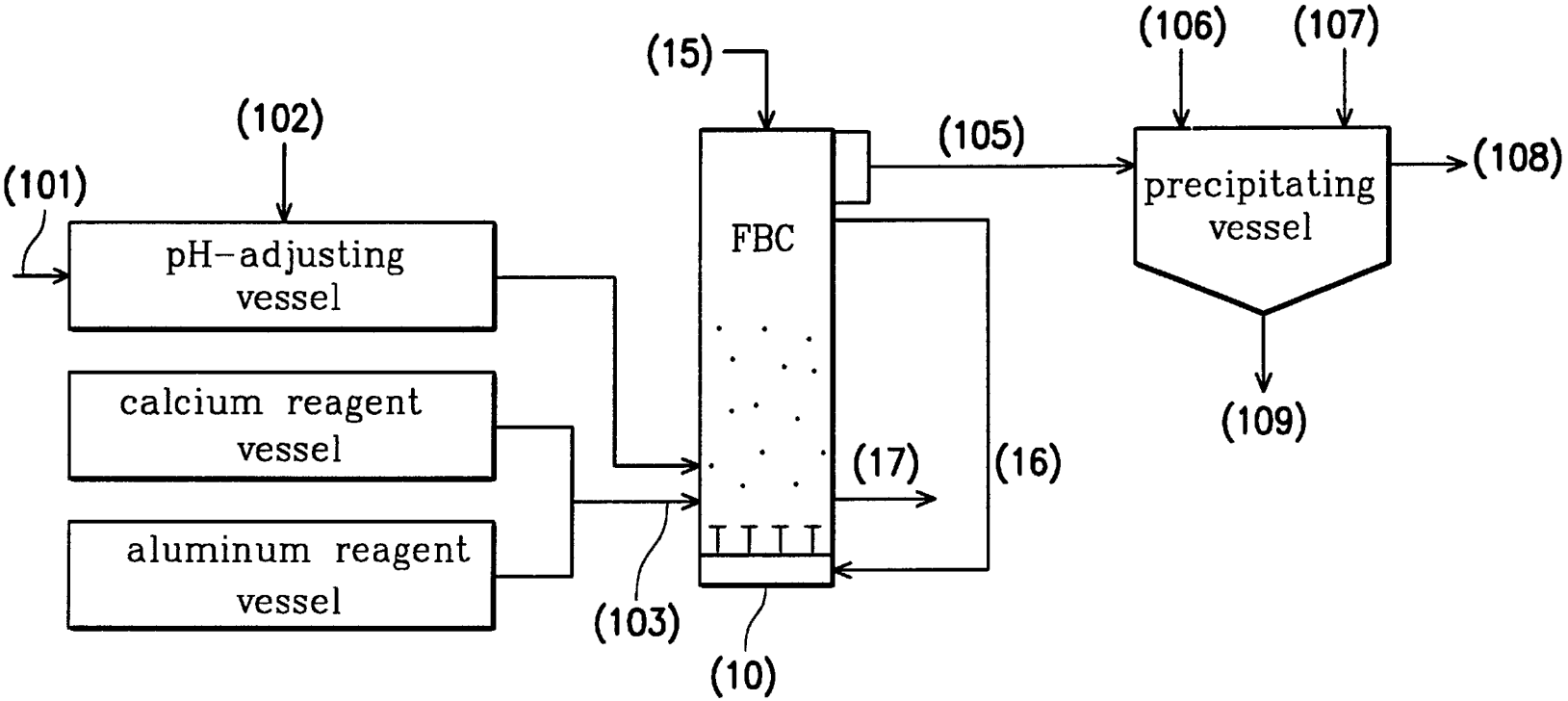
FIG. 1 shows a process for removing fluoride from wastewater in accordance with a first example of the present invention.

Referring to FIG. 1, a fluidized bed crystallizer (FBC) (10) was filled with water and seeded with an adequate amount of carriers. The water was drawn out from the FBC and then introduced back into the FBC as indicated by reference number (16) to fluidize the carriers in the FBC. Acidic fluoride-containing wastewater (101) was introduced into a pH adjusting vessel and was adjusted by NaOH (102) to a pH value of 4.34. The adjusted wastewater containing fluoride and sodium had a concentration of 5200 $mgF^-/l$ and was introduced into the FBC at a flow rate of 10.4 ml/min. Also, a calcium reagent and an aluminum reagent were mixed and then introduced into the FBC (10) as indicated by reference number (103) at a flow rate of 10.4 ml/min, in which the concentration of the calcium ion was 1,630 mg/l and the concentration of the aluminum ion was 1,120 mg/l (it is understood that the calcium reagent and the aluminum reagent can be separately introduced into the FBC). The molar ratio for $Na^+:Al^{+3}:Ca^{+2}:F^-$ in the FBC was 6.2:0.9:0.9:6.0 (the operable condition of the molar ratio generally is $Al^{+3}:Ca^{+2}:F^-$=0.8–1.2:0.8–1.2:6.0 and $Na^+/F^-$ >1/6). Then, pachnolite ($NaCaAlF_6H_2O$) was crystallized on the carriers to form pachnolite grains. After reacting for a period of time, the pachnolite grains of large diameter in the bottom of FBC were discharged as indicated by reference number (17) and new carriers (15) were introduced into the FBC. In the FBC, the fluoride area loading was 10.3 $kgF^-/m^2$ hr. Then, the primary treated water (105) was obtained and drawn out, in which the total fluoride concentration was 291 mg/l and the dissoluble fluoride concentration was 180 mg/l.

The primary treated water (105) was introduced into a precipitating vessel, in which 5.29 g of aluminum chloride (106) was added per liter of primary treated water. The mixture was stirred while 45% aqueous sodium hydroxide (107) was added therein so as to adjust the pH value of the mixture to about 7.0. Then, aluminum hydroxide was formed. After thirty-minutes of stirring, the mixture was left aside so that the aluminum hydroxide coagulated, adsorbed and co-precipitated the fluoride in the mixture to form a white coprecipitation (109). The secondary treated water (108) discharged from the precipitating vessel had a fluoride concentration of 11 $mgF^-/l$, which was satisfactory.

EXAMPLE TWO

Figure 2:
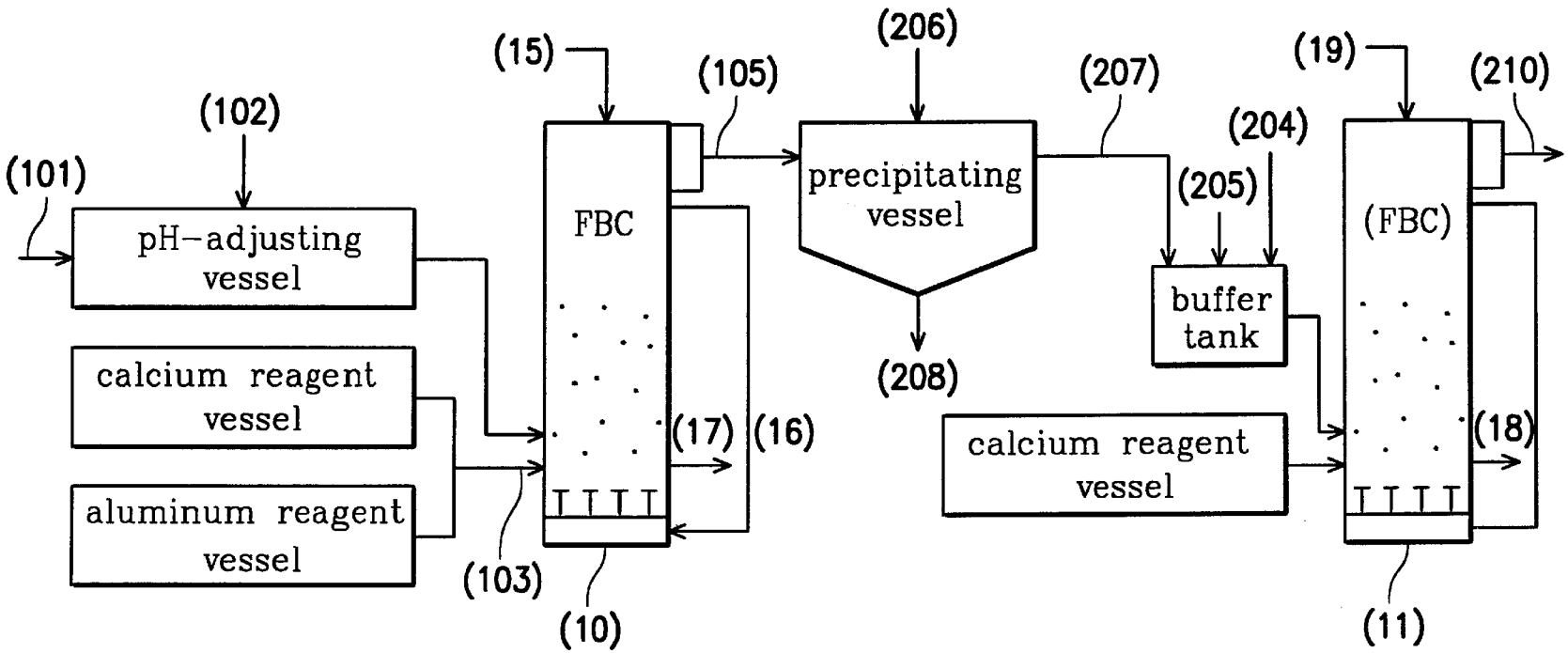
FIG. 2 shows a process for removing fluoride from wastewater in accordance with a second example of the present invention.

Referring to FIG. 2, two FBCs were used in this example, including a first FBC (10) for treating wastewater of high fluoride concentration and a second FBC (11) for treating wastewater of low fluoride concentration. Because example two and example one had the same parts, the descriptions of the same parts are omitted. From example one, it is understood that pachnolite grains were obtained by the first FBC (10). The total fluoride concentration of the primary treated water (105) was 291 mg/l and the dissoluble fluoride concentration was 180 mg/l.

The primary treated water (105) was introduced into a precipitating vessel, in which aqueous sodium hydroxide (206) was added so as to adjust the pH value of the primary treated water to about 7.0. Then, the water soluble aluminum ions in the primary treated water were reacted to form insoluble floc aluminum hydroxide. By stirring, the floc aluminum hydroxide adsorbed the fluoride to form a white coprecipitation (208) and a secondary treated water (207) was obtained.

The fluoride concentration of the secondary treated water was greatly reduced, but not to a satisfactory level. Therefore, the secondary treated water was further treated in the second FBC (11). Before being treated in the second FBC (11), the secondary treated water (207) was introduced into a buffer tank. In this example, another wastewater (205) of low fluoride concentration produced by a factory was selectively introduced into the buffer tank and mixed with the secondary treated water (207) for later treatment in the second FBC (11). NaOH (204) was added into the buffer tank so as to adjust the pH value of the mixed wastewater to 9.21. The fluoride concentration of the mixed wastewater in the buffer tank was 180 mg/l. Then, the mixed wastewater was introduced into the second FBC (11) at a flow rate of 10.0 ml/min. Also, a calcium reagent was introduced into the second FBC (11) from a calcium reagent vessel at a flow rate of 17 ml/min, in which the concentration of the calcium ion was 357 mg/l. The molar ratio for $Ca^{+2}$:$F^-$ in the second FBC was 1.6:1.0 (the operable condition of the molar ratio generally is $Ca^{+2}$:$F^-$=0.5–2:1). Then, $CaF_2$ was crystallized on the carriers to form $CaF_2$ grains. After reacting for a period of time, the $CaF_2$ grains of large diameter in the bottom of the second FBC (11) were discharged as indicated by reference number (18) and new carriers (19) were introduced into the second FBC (11). In the second FBC (11), the fluoride area loading was 0.34 kg$F^-$/$m^2$ hr. Then, the treated water was discharged as indicated by reference number (210). The fluoride concentration of the effluent water was 12 mg/l, which was satisfactory.

EXAMPLE THREE

Figure 3:
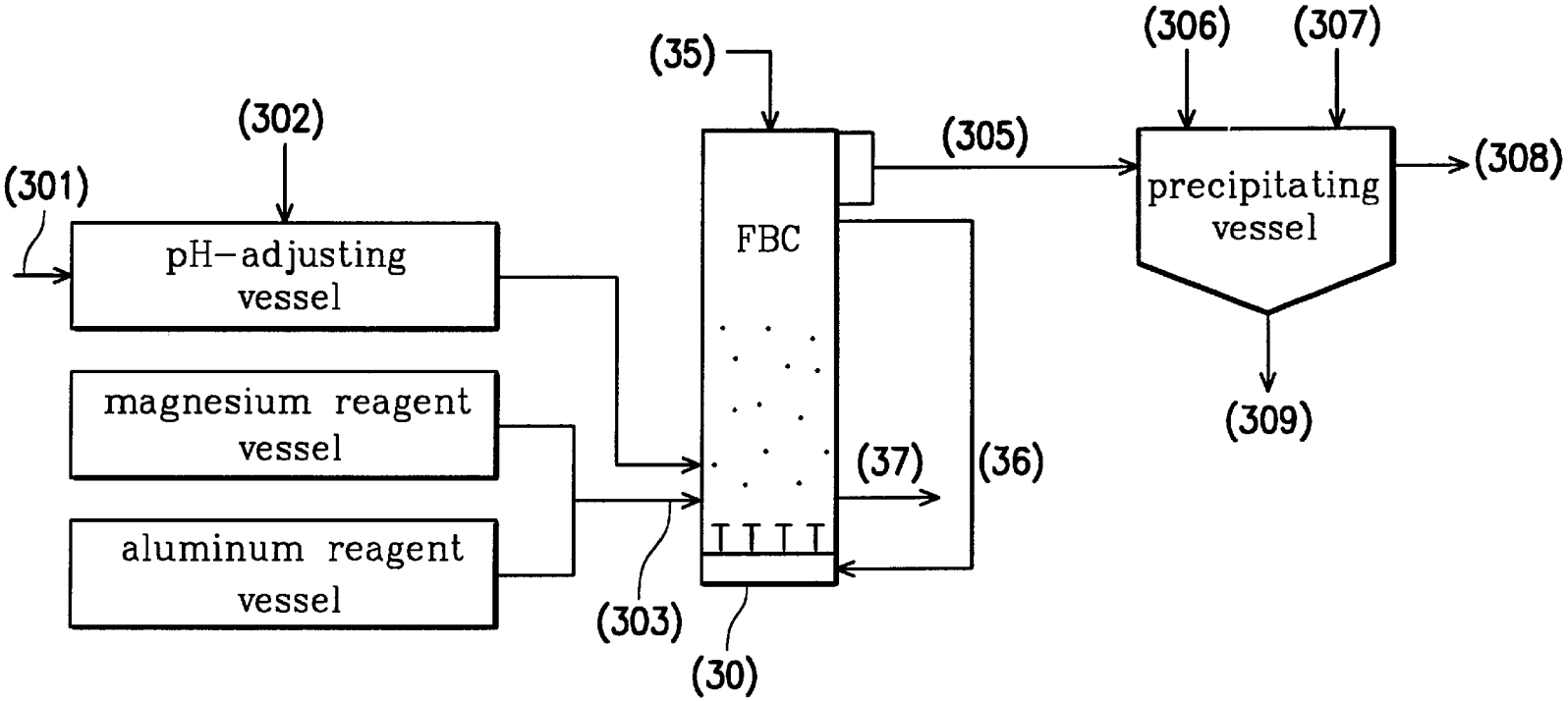
FIG. 3 shows a process for removing fluoride from wastewater in accordance with a third example of the present invention.

The calcium reagent used in Example one can be replaced with a magnesium reagent to treat the wastewater in the FBC. Now referring to FIG. 3, a FBC (30) was filled with water and seeded with an adequate amount of carriers. The water was drawn out from the FBC and then introduced back into the FBC as indicated by reference number (36) to fluidize the carriers in the FBC. Fluoride-containing wastewater (301) was introduced into a pH-adjusting vessel and was adjusted by NaOH (302) to a pH value of 6.2. The adjusted wastewater containing fluoride and sodium had a concentration of 4800 mg$F^-$/l and was then introduced into the FBC (30) at a flow rate of 10.0 ml/min. Also, a mixture (303) of a magnesium reagent and an aluminum reagent was introduced into the FBC (30) at a flow rate of 9.6 ml/min, in which the concentration of the magnesium ion was 900 mg/l and the concentration of the aluminum ion content was 900 mg/l (it is understood that the magnesium reagent and the aluminum reagent can be separately introduced into the FBC). The molar ratio for $Na^+$:$Al^{+3}$:$Mg^{+2}$:$F^-$ in the FBC (30) was 6.6:0.8:0.8:6.0 (the operable condition of the molar ratio generally is $Al^{+3}$:$Mg^{+2}$:$F^-$=0.8–1.2:0.8–1.2:6.0 and $Na^+$/$F^-$>1/6). Then, sodium magnesium aluminum fluoride ($NaMgAlF_6$) was crystallized on the carriers to form $NaMgAlF_6$ grains. After reacting for a period of time, the $NaMgAlF_6$ grains of large diameter in the bottom of the FBC were discharged as indicated by reference number (37) and new carriers (35) were introduced into the FBC. In the FBC, the fluoride area loading was 9.2 kg $F^-$/$m^2$ hr. Then, primary treated water (305) was obtained and drawn out, in which the total fluoride concentration was 306 mg/l and the dissoluble fluoride concentration was 240 mg/l.

The primary treated water (305) was introduced into a precipitating vessel, in which aluminum chloride (306) was added. Also, the pH value in the precipitating vessel was adjusted to about 7.0 by adding 45% aqueous sodium hydroxide (307) therein. In this example, the aluminum chloride (306) was added twice. First, 2.325 g of aluminum chloride was added per one liter of the primary treated water. The pH value of the primary treated water was 4.22. Then, the pH value in the precipitating vessel was adjusted to about 7.0 by adding 45% aqueous sodium hydroxide (307) therein. Then, the mixture was stirred for fifteen minutes. Again, 2.325 g of aluminum chloride was added per one liter of the primary treated water. At that time, the pH value of the primary treated water became 4.26. Then, the pH value in the precipitating vessel was adjusted to about 7.04 by adding 45% aqueous sodium hydroxide (307) therein. The mixture was left aside after fifteen-minutes of stirring so as to form a white coprecipitation (309). The secondary treated water (308) discharged from the precipitating vessel had a fluoride concentration of 14 mg$F^-$/l, which was satisfactory.

EXAMPLE FOUR

Figure 4:
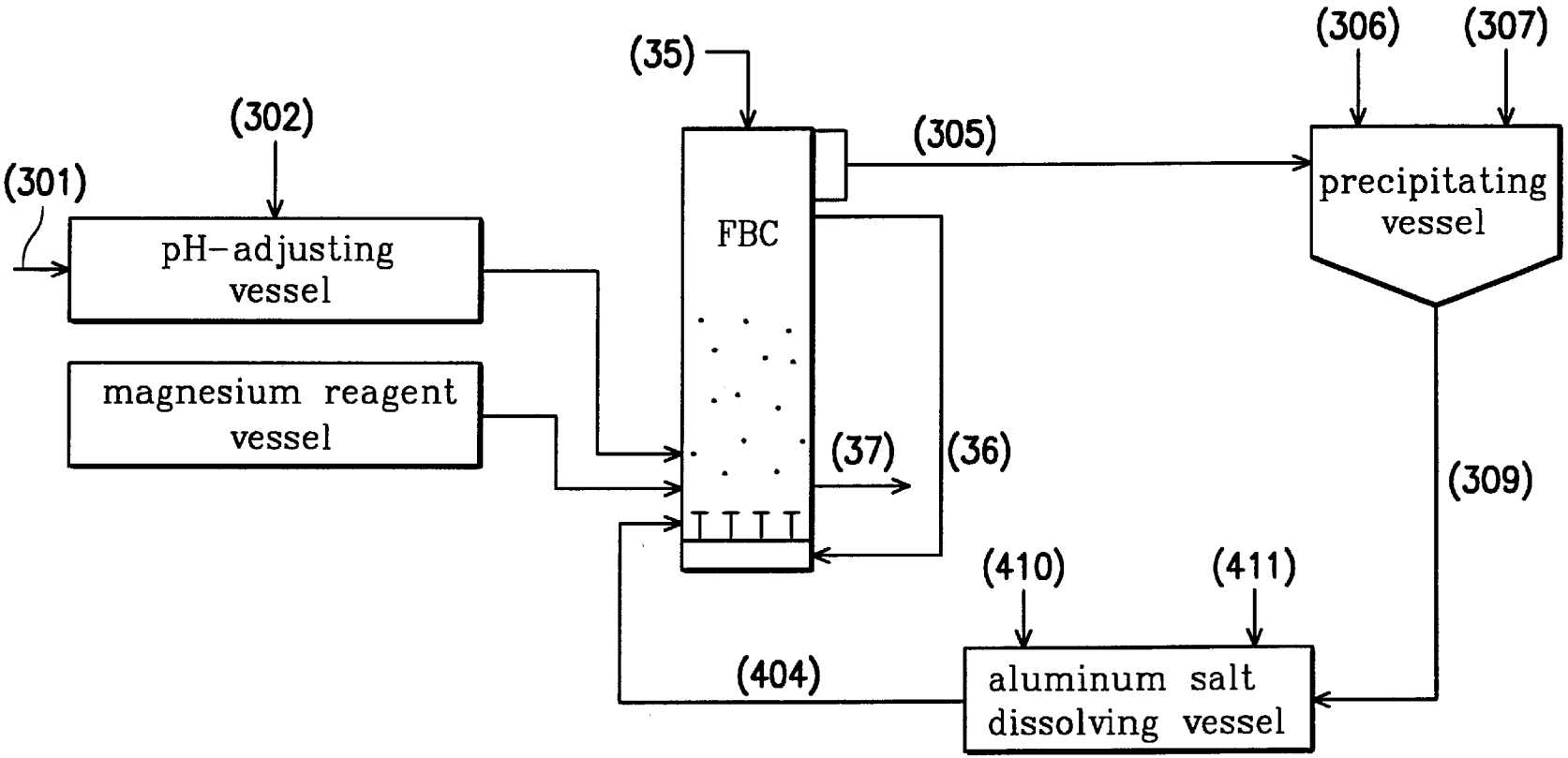
FIG. 4 shows a process for removing fluoride from wastewater in accordance with a fourth example of the present invention.

The coprecipitation (309) obtained from example three contains aluminum eons which can be recycled for utilization. Now referring to FIG. 4, the white coprecipitation (309) of aluminum hydroxide and fluoride obtained from example three was added to an aluminum salt dissolving vessel. Reference number (410) indicates hydroxide of an alkaline metal or sulfuric acid, either of which can dissolve the aluminum hydroxide in the aluminum salt dissolving vessel. For example, hydroxide of an alkaline metal (410) was added into the aluminum salt dissolving vessel to adjust the pH value therein to a value greater than 11 so that the aluminum hydroxide was dissolved to release aluminum ions. Alternatively, sulfuric acid (410) was added into the aluminum salt dissolving vessel to adjust the pH value therein to a value less than 3 so that the aluminum hydroxide was dissolved to release aluminum ions. Then, aluminum chloride (411) was added into the aluminum salt dissolving vessel to obtain an aluminum mixture (404) of a concentration of 1,040 mg$Al^{+3}$/l. The mixture (404) was introduced into the FBC in which the molar ratio for $Na^+$:$Al^{+3}$:$Mg^{+2}$:$F^-$ was 10.4:0.8:0.9:6.0. Then, $NaMgAlF_6$ was crystallized on the carriers and a primary treated water (305) was obtained, in which the total fluoride concentration was 224 mg/l and the dissoluble fluoride concentration was 200 mg/l.

The primary treated water (305) was introduced into the precipitating vessel. Aluminum chloride (306) was added into the precipitating vessel and the pH value therein was adjusted to about 7.0 by adding 45% aqueous sodium hydroxide (307). Then, a white coprecipitation (309) was obtained. The secondary treated water (308) discharged from the precipitating vessel had a fluoride concentration of 9 $mgF^-/l$, which was satisfactory.

Now, example four and example three are compared. The aluminum salt was added to the precipitating vessel in example four, as compared to being added to the FBC in example three. That is, the aluminum salt was added at the position (306) in example four while at the position (303) in example three. In example four, therefore, the aluminum ions used to coagulate, adsorb and co-precipitate fluoride in the precipitating vessel came from the added aluminum chloride (306) and the primary treated water (305). The aluminum ions were recycled by dissolving the white coprecipitation (309) and then added to the FBC. When the amount of the recycled aluminum ions was not adequate to treat fluoride in the FBC, aluminum salt (411) was replenished. By this way, the aluminum reagent vessel mentioned in example three was not needed in example four. The amount of consumed aluminum reagent in example four was less than that in example three. It is understood that the effect of removing fluoride in example four is superior to that in example three when the amounts of consumed aluminum reagents in example three and example four are the same. That is because the aluminum salt (306) in example four was used to treat the primary treated water (305), in which the concentration of fluoride was low, rather than the fluoride-containing wastewater (301) in which the concentration of fluoride was high.

In conclusion, the present invention can use calcium reagent (see example one and example two) or magnesium reagent (see example three and example four). Furthermore, the present invention can use two fluidized bed crystallizers to treat wastewater (see example two). Furthermore, the aluminum in the precipitating vessel can be recycled for utilization (see example four). It is understood that the present invention can be put into practice by optionally combining two or more of the four examples. For example, magnesium reagent (example three and example four) and two fluidized bed crystallizers (example two) can be combined to treat wastewater.

While the invention has been described by way of example and in terms of the preferred embodiment, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A process for removing fluoride from wastewater, comprising the following steps of:

(a) introducing a first fluoride-containing wastewater into a first fluidized bed crystallizer having first carriers inside; and (b) adding a first water soluble calcium reagent, sodium reagent and aluminum reagent into the first fluidized bed crystallizer to form pachnolite on the first carriers so as to remove fluoride from the first fluoride-containing wastewater and obtain a primary treated water, wherein the molar ratio for calcium:aluminum-:fluoride in the first fluidized bed crystallizer is 0.8–1.2:0.8–1.2:6.0 and the molar ratio of sodium to fluoride in the first fluidized bed crystallizer is greater than 1/6.

2. A process for removing fluoride from wastewater as claimed in claim 1, further comprising (c) adding a second water soluble aluminum reagent into the primary treated water;

(d) adjusting the primary treated water to a pH value of about 7 by a first hydroxide of an alkaline metal to form aluminum hydroxide which coagulates, adsorbs and co-precipitates the fluoride in the primary treated water to form a coprecipitate and obtain a secondary treated water.

3. A process for removing fluoride from wastewater as claimed in claim 2, further comprising:

(e) adjusting the coprecipitate to a pH value of greater than 11 by a second hydroxide of an alkaline metal or less than 3 by a sulfuric acid reagent so as to dissolve the coprecipitate to obtain aluminum ions;

(f) adding the aluminum ions into the first fluidized bed crystallizer.

4. A process for removing fluoride from wastewater as claimed in claim 2, further comprising:

(e) adding the coprecipitate and a third water soluble aluminum reagent to an aluminum salt dissolving vessel;

(f) adjusting a pH value in the aluminum salt dissolving vessel to greater than 11 by a second hydroxide of an alkaline metal or less than 3 by a sulfuric acid reagent so as to dissolve the coprecipitate to obtain aluminum ions;

(g) adding the aluminum ions into the first fluidized bed crystallizer.

5. A process for removing fluoride from wastewater as claimed in claim 1, further comprising:

(e) adjusting a pH value of the primary treated water to about 7 by a hydroxide of an alkaline metal so as to form floc aluminum hydroxide which adsorbs the fluoride in the primary treated water to form a coprecipitate and obtain a secondary treated water.

6. A process for removing fluoride from wastewater as claimed in claim 5, further comprising:

(f) introducing the secondary treated water into a second fluidized bed crystallizer having second carriers inside; and (g) adding a second water soluble calcium reagent into the second fluidized bed crystallizer to form calcium fluoride on the second carriers so as to remove the fluoride from the secondary treated water, wherein the molar ratio of calcium:fluoride in the second fluidized bed crystallizer is 0.5–2:1.

7. A process for removing fluoride from wastewater as claimed in claim 5, further comprising:

(f) mixing the secondary treated water with a second fluoride-containing wastewater as a mixture, wherein a fluoride concentration of the second fluoride-containing wastewater is less than a fluoride concentration of the first fluoride-containing wastewater;

(g) introducing the mixture into a second fluidized bed crystallizer having second carriers inside;

(h) adding a second water soluble calcium reagent into the second fluidized bed crystallizer to form calcium fluoride on the second carriers so as to remove the fluoride from the secondary treated water, wherein the molar ratio of calcium:fluoride in the second fluidized bed crystallizer is 0.5–2:1.

8. A process for removing fluoride from wastewater, comprising the following steps of:

(a) introducing a first fluoride-containing wastewater into a first fluidized bed crystallizer having first carriers inside; and (b) adding a first water soluble magnesium reagent, sodium reagent and aluminum reagent into the first fluidized bed crystallizer to form sodium magnesium aluminum fluoride on the first carriers so as to remove fluoride from the first fluoride-containing wastewater and obtain a primary treated water, wherein the molar ratio for magnesium:aluminum:fluoride in the first fluidized bed crystallizer is 0.8–1.2:0.8–1.2:6.0 and the molar ratio of sodium to fluoride in the first fluidized bed crystallizer is greater than 1/6.

9. A process for removing fluoride from wastewater as claimed in claim 8, further comprising (c) adding a second water soluble aluminum reagent into the primary treated water;

(d) adjusting the primary treated water to a pH value of about 7 by a first hydroxide of an alkaline metal to form aluminum hydroxide which coagulates, adsorbs and co-precipitates the fluoride in the primary treated water to form a coprecipitate and obtain a secondary treated water.

10. A process for removing fluoride from wastewater as claimed in claim 9, further comprising:

(e) adjusting the coprecipitate to a pH value of greater than 11 by a second hydroxide of an alkaline metal or less than 3 by a sulfuric acid reagent so as to dissolve the coprecipitate to obtain aluminum ions;

(f) adding the aluminum ions into the first fluidized bed crystallizer.

11. A process for removing fluoride from wastewater as claimed in claim 9, further comprising:

(e) adding the coprecipitate and a third water soluble aluminum reagent to an aluminum salt dissolving vessel;

(f) adjusting a pH value in the aluminum salt dissolving vessel to greater than 11 by a second hydroxide of an alkaline metal or less than 3 by a sulfuric acid reagent so as to dissolve the coprecipitate to obtain aluminum ions;

(g) adding the aluminum ions into the first fluidized bed crystallizer.

12. A process for removing fluoride from wastewater as claimed in claim 8, further comprising:

(e) adjusting a pH value of the primary treated water to about 7 by a hydroxide of an alkaline metal so as to form aluminum hydroxide floc which adsorbs the fluoride in the primary treated water to form a coprecipitate and obtain a secondary treated water.

13. A process for removing fluoride from wastewater as claimed in claim 12, further comprising:

(f) introducing the secondary treated water into a second fluidized bed crystallizer having second carriers inside; and (g) adding a second water soluble calcium reagent into the second fluidized bed crystallizer to form calcium fluoride on the second carriers so as to remove the fluoride from the secondary treated water, wherein the molar ratio of calcium:fluoride in the second fluidized bed crystallizer is 0.5–2:1.

14. A process for removing fluoride from wastewater as claimed in claim 12, further comprising:

(f) mixing the secondary treated water with a second fluoride-containing wastewater as a mixture, wherein a fluoride concentration of the second fluoride-containing wastewater is less than a fluoride concentration of the first fluoride-containing wastewater;

(g) introducing the mixture into a second fluidized bed crystallizer having second carriers inside;

(h) adding a second water soluble calcium reagent into the second fluidized bed crystallizer to form calcium fluoride on the second carriers so as to remove the fluoride from the secondary treated water, wherein the molar ratio of calcium:fluoride in the second fluidized bed crystallizer is 0.5–2:1.

* * * * *